US005919542A

United States Patent [19]

Chou

[11] Patent Number: 5,919,542

[45] Date of Patent: Jul. 6, 1999

[54] TASSEL FOR PULL CORDS AND CHAINS

[75] Inventor: Gene Chou, Villa Park, Calif.

[73] Assignee: Rainbow Industrial, Inc., Anaheim, Calif.

[21] Appl. No.: 09/007,087

[22] Filed: Jan. 14, 1998

[51] Int. Cl.[6] ..... E06B 9/30

[52] U.S. Cl. ..... 428/99; 160/178.1; 16/122

[58] Field of Search ..... 428/99, 64.1; 160/178.1; 24/116 A, 128; 16/122

*Primary Examiner*—Alexander Thomas
*Attorney, Agent, or Firm*—Robert R. Thornton

[57] ABSTRACT

A tassel for use with venetian blind cords and chains has a generally bell-shaped hollow cap adapted to permit the passage of the cord or chain therethrough and a depending lip formed around the open end thereof with an internal annular recess formed thereon, and a receiver, adapted to be contained within the cap and adapted to permit the passage thereinto of said chain or cord and having a keyhole-type aperture extending radially across the closed receiver bottom and a peripheral lip formed thereon and adapted to lock into the cap annular recess. The cap and receiver are assembled by pressing the receiver into the hollow interior of the cap until receiver peripheral lip snaps into the cap annular recess.

12 Claims, 3 Drawing Sheets

TASSEL FOR PULL CORDS AND CHAINS

FIELD OF THE INVENTION

This invention relates to a tassel for use with pull cords and chains, particularly in connection with venetian blinds.

BACKGROUND OF THE INVENTION

Venetian blinds, whether of the horizontal louver or vertical louver type, have traditionally used one of two devices, either a wand or a loose loop of cord or chain, to rotate the actuating mechanism for adjusting the louver angle. Recently, the use of the loop type of control has been recognized as a possible safety hazard for infants, who may become entangled in the loop. Consequently, the ANSI/WCMA A100.1-1966 safety standard provides for the elimination of the loose loop in existing venetian blind designs by, inter alia, the cutting of the loop and the attaching of tassels to the two resulting cord or chain ends. New designs of venetian blinds, in order to meet this standard, may be supplied with the cord or chain already cut and tassels attached to each of the two ends. However, conventional open ended bell shaped tassels do not adequately lock the chain or cord end within the tassel so as to limit access to it, or provide a ready means for extending the length of the cord or chain if a longer cord or chain is required than is already installed on the blind.

SUMMARY OF THE INVENTION

According to the present invention, a tassel for use with venetian blind cords and chains has a generally bell-shaped hollow cap with an axial bore extending through the closed end thereof adapted to permit the passage of the cord or chain therethrough and a depending lip formed around the open end thereof with an internal annular recess formed thereon, and a receiver, adapted to be contained within the cap, and having a top and a base with an axial bore extending through the top adapted to permit the passage therethrough of said chain or cord and a keyhole type aperture extending radially across the base of with a peripheral lip formed thereon adapted to lock into the cap annular recess, the cap and the receiver being assembled to form the tassel by pressing the receiver into the hollow interior of the cap until the receiver peripheral lip snaps into the cap annular recess.

BRIEF DESCRIPTION OF THE DRAWING

The invention may be more readily understood by reference to the accompanying drawing, in which.

DETAILED DESCRIPTION OF THE PREFERRED EMBODIMENTS

Figure 1:
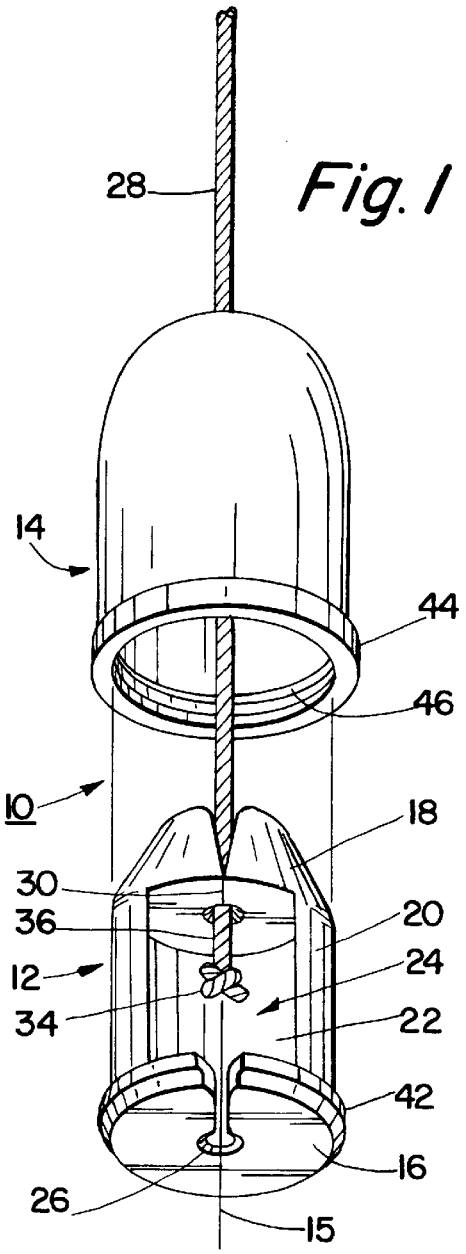
FIG. 1 is an exploded perspective view of a tassel according to the present invention shown as being utilized with a venetian blind cord.

Referring now to FIG. 1, a tassel 10 is shown in an exploded view as consisting of a receiver 12 and a cap 14 aligned along a longitudinal axis 15. The receiver 12 has a base 16 and a top 18, which are connected together by a parti-cylindrical peripheral wall 20, having an opening 22 therein so as to open into an open interior space 24 formed between the receiver base 16 and receiver top 18. The receiver base 16 has a radial slot 26 formed therein in order to assist in the locking of the cap to the receiver by lateral compression of the base 16, as will be explained hereinafter. In the preferred embodiment, the radial slot is in the form of a keyhole, in order to assist in the addition of a cord or chain extension, as described hereinafter with respect to FIGS. 7 and 8. A cord 28, such as is conventionally used to control the louver disposition in a venetian blind, extends through the cap 14 and the receiver top 18 into the open interior space 24 of the receiver 12.

The receiver top 18 has a radial cut 30 extending therethrough from the exterior surface of the top 18 to an axial bore 32 (see FIG. 2) to facilitate the insertion of the cord 28 into the passageway 32 without the necessity of threading the cord 28 through the axial bore 32 before a knot 34 is formed on an end portion 36 of the cord 28 in order to retain the cord end portion 36 within the tassel 10. The receiver 12 and cap 14 are formed, typically, of any appropriate somewhat resilient plastic material, although an appropriately resilient metallic construction can be substituted, if desired.

Figure 2:
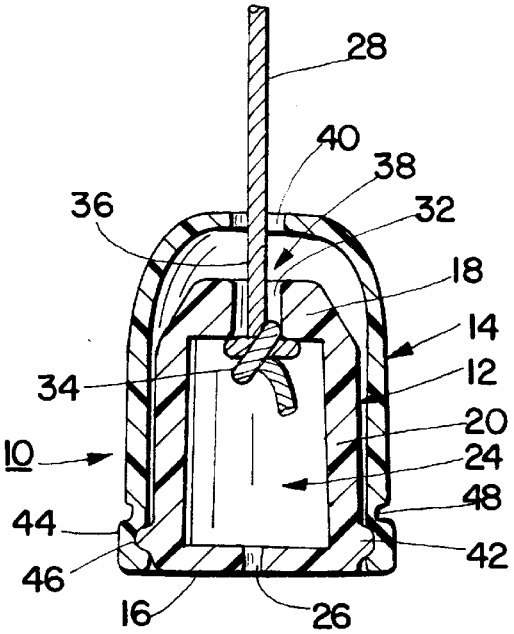
FIG. 2 is a side elevational view, in section, of the tassel of FIG. 1 in its assembled form.

Referring now to FIG. 2, the tassel 10 is shown in section in its assembled form. The cap 14 is seen to be generally bell-shaped, with a hollow interior space 38 within which the receiver 12 is disposed. The cap 14 has an aperture 40, through which the cord 36 extends. The cord end 36 is prevented from being pulled out of the tassel 10 through the receiver top axial bore 32 by the cord end knot 34, which is too large to pass through the axial bore 32. The receiver base 16 has a peripheral lip 42 formed thereon for purposes of attaching the receiver 12 to the cap 14. For this purpose, the cap 14 terminates at its open end in a depending lip 44 having an annular recess 46 formed therein for receiving the peripheral lip 42.

Figure 3A:
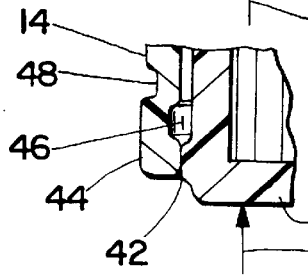
FIG. 3, parts A and B being taken together, are partial sectional views illustrating the structure for the attachment together of the two components of the tassel illustrated in their separated forms in FIG. 1.
Figure 3B:
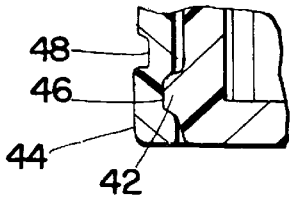

Referring now to FIG. 3, parts A and B being taken together, the assembly of the receiver 12 and cap 14 is illustrated. In FIG. 3A, an arrow 47 illustrates the direction of relative movement between the receiver 12 and cap 14. with the cap 14 being considered as stationary. As the receiver 12 and cap 14 are forced together, the cap depending lip 44 engages the receiver peripheral lip 42, causing the slot 26 in the receiver base 16 to narrow, thereby contracting the perimeter of the base peripheral lip 42 so as to permit the lip 42 to pass within the cap depending lip 44 as is shown in FIG. 3A. The opening 22 in the partial peripheral wall 20 assists in the contraction of the perimeter of the lip 42. As is shown in FIG. 3B, when the base peripheral lip 42 reaches the cap depending lip annular recess 46, the peripheral lip 42 snaps back from its contracted perimeter condition to fill the annular recess 46, thereby locking the receiver 12 and cap 14 together. An annular recess 48 formed on the cap 14 immediately above the depending lip 44 provides added resilience to the depending lip area of the cap 14, so as to assist in the unlocking of the cap and receiver.

Figure 4:
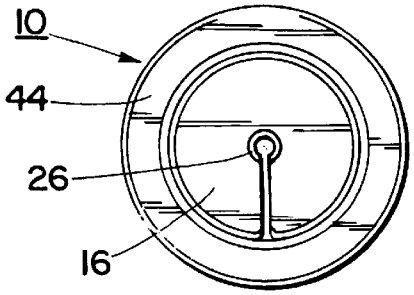
FIG. 4 is a bottom plan view of the tassel of FIG. 2.

FIG. 4 is a bottom plan view of the tassel illustrating the locked disposition of the receiver 12 and cap 14 shown in partial section in FIG. 3B.

Figure 5:
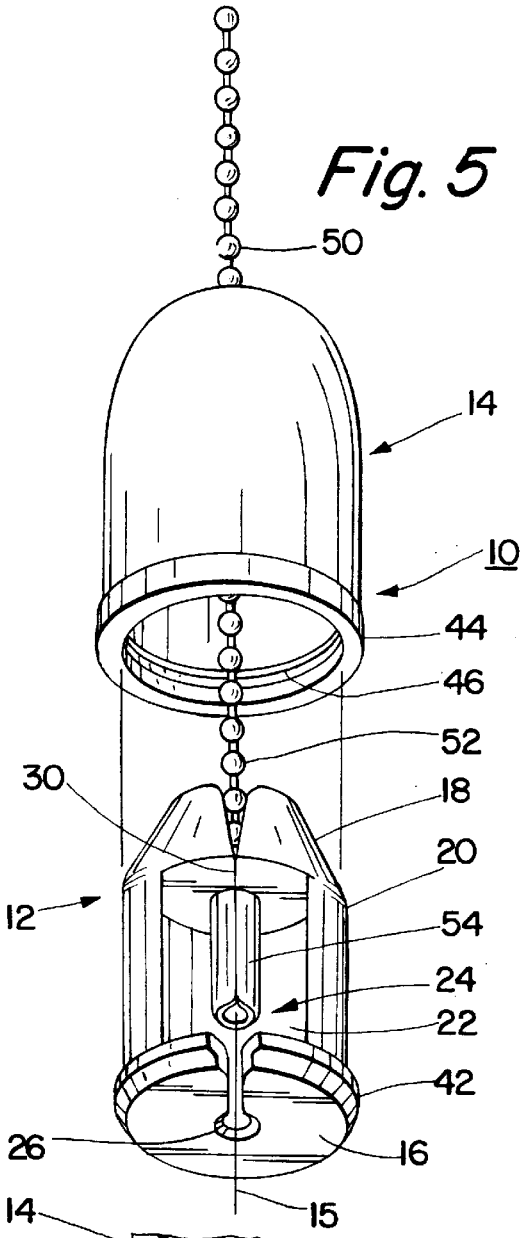
FIG. 5 is an exploded view, similar to FIG. 1, but illustrating the use of a venetian blind chain, rather than a cord, with the tassel of FIG. 1.
Figure 6:
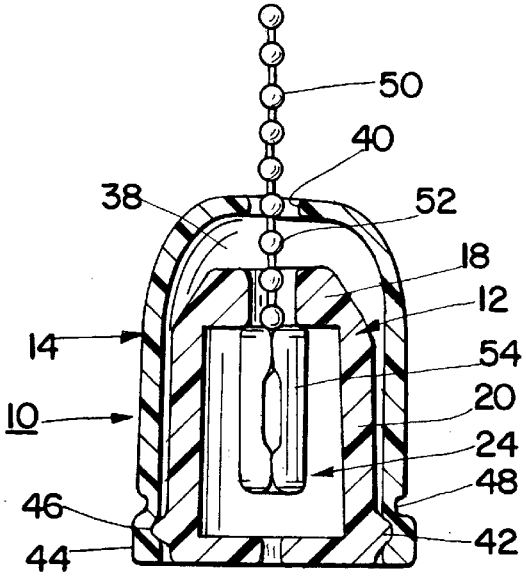
FIG. 6 is a side elevational view, in section, similar to FIG. 2, but illustrating the use of a chain, rather than a cord, with the tassel of FIG. 2.
Figure 7:
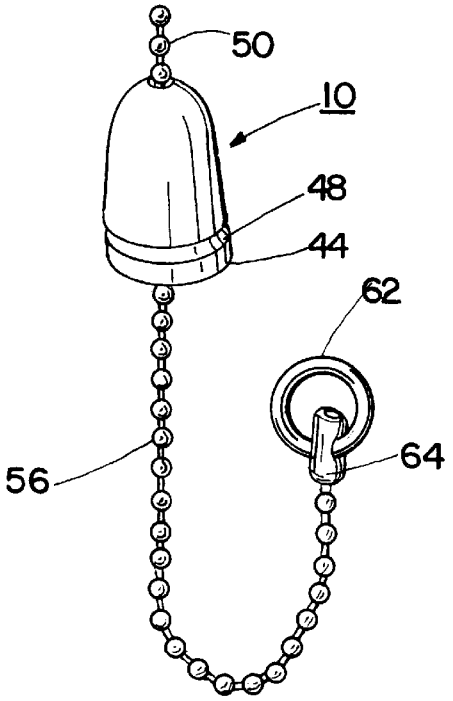
FIG. 7 is a perspective view of the tassel of FIG. 6, with an extension chain added to the tassel.
Figure 8:
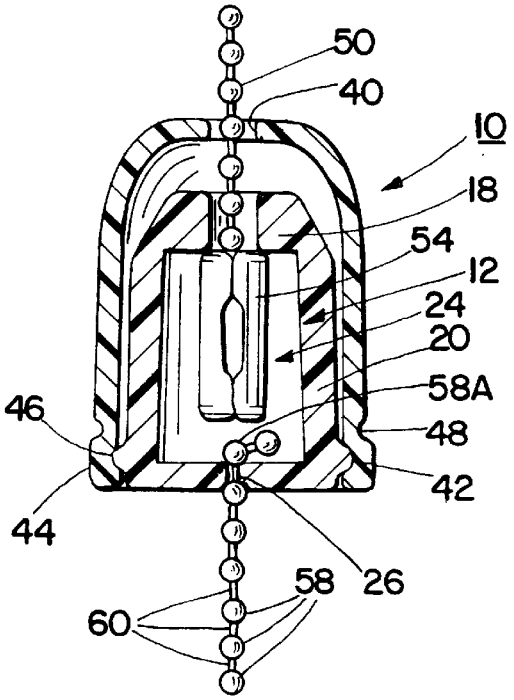
FIG. 8 is a side elevational view, in section, of the tassel and chain extension of FIG. 7.

FIG. 5 is an exploded view of the tassel 10, similar to FIG. 1, but in which a ball-type venetian blind chain 50 has been substituted for the cord 28 of FIG. 1. The tassel 10, itself, in FIG. 5, and in FIGS. 6, 7, and 8, is identical to the tassel 10 of FIGS. 1, 2, 3 and 4, and like reference numbers refer to identical parts. The chain 50 has a chain end 52 to which a conventional chain connector 54 is attached so as to provide a chain end termination equivalent to the cord end knot 34 of FIGS. 1 through 4.

FIG. 6 is similar to FIG. 2, and illustrates the manner by which the chain connector 54 functions to retain the chain end 52 within the tassel 10.

FIGS. 7 and 8 illustrate the utilization of the tassel 10 and chain 50 of FIGS. 5 and 6 with a ball-type chain extension 56 having a series of chain balls 58 connected together by link elements 60 in conventional fashion. A pull ring 62 is attached to the chain extension 56 by a second chain connector 64. The chain extension 56 is held within the tassel 10 by being inserted into the preferred keyhole-type configuration of the slot 26 formed in the receiver base 12. A chain ball 58A, of a diameter larger than the width of the keyhole aperture portion of the slot 26 and located within the receiver open space 24, serves to keep the chain extension 56 attached to the tassel 10. The purpose of the chain extension is to extend the effective length of the chain 50 if, for whatever reason, the original length is insufficient to satisfy the user.

While the use of the extension chain 56 has been illustrated only in connection with the embodiment of FIGS. 5 and 6, obviously, it can also be used with the embodiment of FIGS. 1 through 4, if desired. In addition, as an alternative, a cord extension utilizing a separate piece of the cord 28 and a knot such as the knot 34 can be substituted for the chain extension 56 and chain ball 58A, if desired, in either embodiment, in which event an appropriate cord termination, such as another tassel 10 and knot 34, can be substituted for the ring 62 and connector 64.

Figure 9:
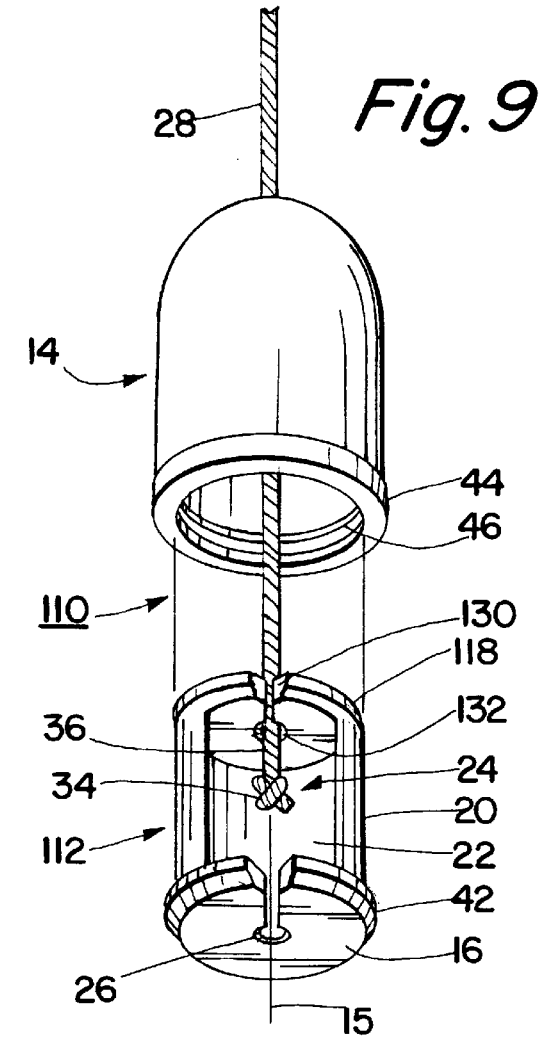
FIG. 9 is is an exploded perspective view of n alternate embodiment of a tassel according to the present invention shown as being utilized with a venetian blind cord.

FIG. 9 is an exploded view of a tassel 110, similar to the tassel 10 of FIG. 1, and like reference numbers refer to identical parts. The tassel 110 is shown in an exploded view as consisting of a receiver 112 and the cap 14 aligned along a longitudinal axis 15. The receiver 112 includes the base 16 and a top 118, which are connected together by the partic-ylindrical peripheral wall 20, with the opening 22 therein opening into the open interior space 24 formed between the receiver base 16 and receiver top 118. The radial slot 26 formed in the receiver base assists in the locking of the cap to the receiver 12 by lateral compression of the base 16, as in the earlier-described embodiments. In the preferred embodiment of the receiver 112, the radial slot is in the form of a keyhole, in order to assist in the addition of a cord or chain extension, as described above with respect to FIGS. 7 and 8. The cord 28, such as is conventionally used to control the louver disposition in a venetian blind, extends through the cap 14 and the receiver top 118 into the open interior space 24 of the receiver 112.

The receiver top 118 is generally similar in configuration to, but of a smaller diameter than, the receiver base 16. The receiver top 118 has a radial slot 130 extending therethrough from the exterior surface of the top 118 to an axial bore 132, through which the cord 28 is passed into the passageway 32 without the necessity of threading the cord 28 through the axial bore 32 before the knot 34 is formed in order to retain the cord end portion 36 within the receiver 112. The radial slot 130, in combination with the axial bore 132, preferably is of a keyhole-type configuration in lateral cross-section in order to facilitate the passage of the cord 36 into the space 24, within which it is held by the knot 34, which is larger that the axial bore 132. The receiver 112 and cap 14 are formed, typically, of any appropriate somewhat resilient plastic material, although an appropriately resilient metallic construction can be substituted, if desired.

Figure 10:
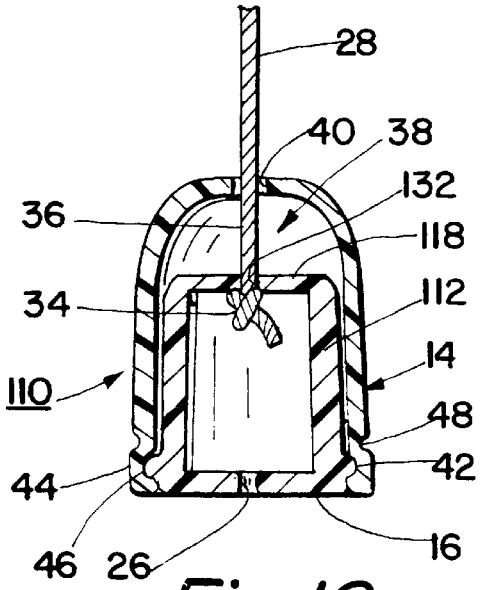
FIG. 10 is a side elevational view, in section, of the tassel of FIG. 9 in its assembled form.

Referring now to FIG. 10, the tassel 110 is shown in section in its assembled form. The cap 14 is seen to be generally bell-shaped, with a hollow interior space 38 within which the receiver 112 is disposed. The cord end 36 extends through the cap aperture 40 extends and is prevented from being pulled out of the tassel 110 through the receiver top axial bore 132 by the cord end knot 34, which is too large to pass through the axial bore 132. The 16 receiver base 16 has the peripheral lip 42 formed thereon for purposes of attaching the receiver 112 to the cap 14. For this purpose, the cap 14 terminates at its open end in the depending lip 44 having the annular recess 46 formed therein for receiving the peripheral lip 42.

Figure 11:
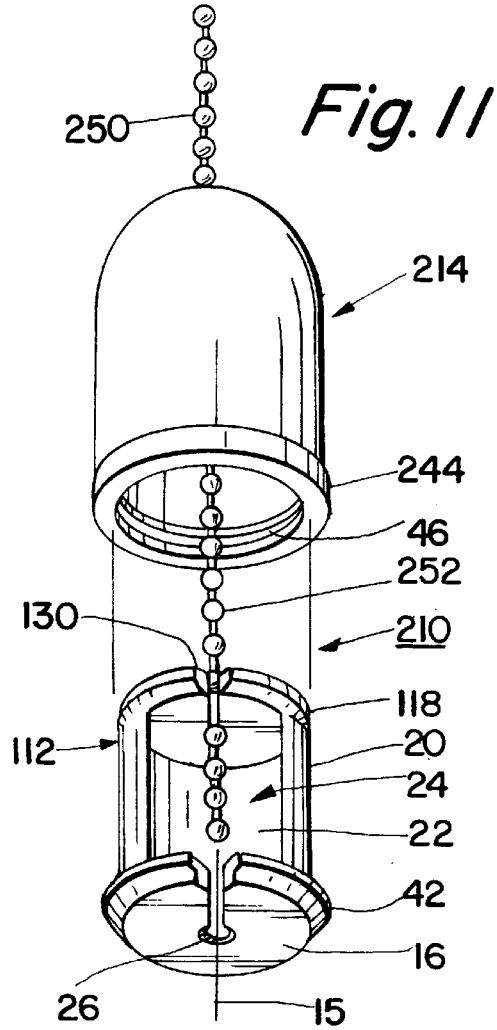
FIG. 11 is an exploded view another alternate embodiment, similar to the embodiment of FIG. 9, which illustrates the use of a venetian blind chain, rather than a cord, with the tassel of this alternate embodiment.
Figure 12:
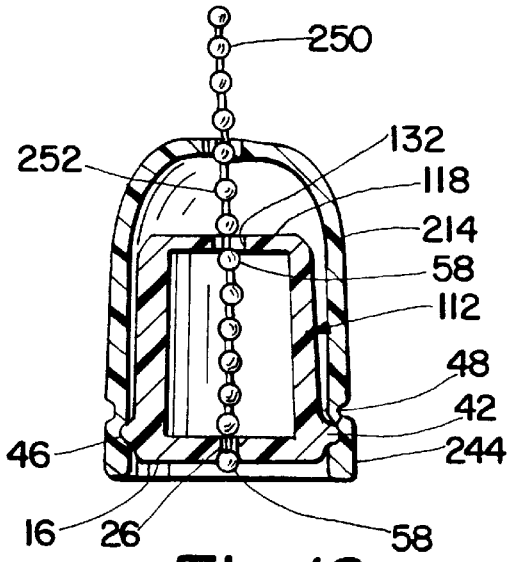
FIG. 12 is a side elevational view, in section, similar to FIG. 10, but illustrating one specific use of the chain with the tassel of FIG. 11.

FIG. 11 is an exploded view of a tassel 210, similar to the tassel 110 of FIG. 9, but in which a ball-type venetian blind chain 250, similar to the chain 50 of FIGS. 7 and 8, has been substituted for the cord 28 of FIG. 9. Like reference numbers refer to identical parts. The chain 250 has a series of chain balls 58 connected together by link elements 60 in conventional fashion. The chain 250 has a chain element 252 which is held within the tassel 210 by being inserted into the preferred keyhole-type configuration of the slot 132 in the receiver top 118. The chain ball 58, of a diameter larger than the width of the keyhole aperture portion of the slot 132 and located within the receiver open space 24, engages the slot 132 so as to keep the chain 50 attached to the tassel 210. A second chain ball 58 may be disposed outside of the tassel 210 adjacent the receiver base 16, through which the chain 250 is shown as passing in FIG. 12, so as to further lock the chain 50 to the tassel 210. In such an embodiment, the cap element preferably has an extended depending lip 244, in order to contain the second chain ball 58 within the overall cross-section of the tassel 210.

Alternatively, if desired, the chain element 252 may be terminated within the receiver 112, as is the case with the chain element 58 shown in FIG. 8, in the event that it is not desired to lock the chain 50 to base 16. Additionally, if a chain extension feature similar to the chain extension 56 of FIGS. 7 and 8 is desired, either the chain element 252 can be one continuous chain element continuing out beyond the base 16 for the desired length, or the chain element 252 can be terminated within the receiver 118, and a chain extension 56 utilized to provide the desired additional chain length, as is shown in FIGS. 7 and 8.

Although the presently preferred embodiments of the invention have been set forth herein in detail for illustrative purposes, it will be apparent to those skilled in the art that variations and modifications thereof, including the rearrangement of parts, lie within the scope of the present invention, which is not limited to the specific structures of the embodiments shown or described herein, but only by the scope of the following claims.

The invention claimed is:

1. A tassel for use with venetian blind cords and chains, comprising:

a cap, and a receiver adapted to be contained within the cap, the cap (a) being generally bell-shaped in longitudinal cross section with an open end and a closed end, (b) having an axial bore extending through the closed end and adapted for receiving said chain or cord, and (c) having a depending lip at the open end, within which is formed an annular recess, and the receiver (d) having a top element and a base element which are axially aligned longitudinally and are generally circular in lateral cross-section and are connected together by an axially-aligned parti-cylindrical peripheral wall element partially enclosing an open space formed therebetween, (e) said top element having an axial bore extending therethrough so as to open into said open space for receiving said chain or cord, and (f) said base element having (g) an axial bore extending therethrough, (h) a peripheral lip formed thereon and adapted to lock into said cap annular recess, and (i) a radial slot extending outwardly from the base element axial bore through the peripheral lip;

said cap and said receiver being assembled by pressing said receiver top into said hollow interior of said cap until said peripheral lip snaps into said annular recess.

2. A tassel according to claim 1, and in which the top element includes a radial slot extending outwardly from the top element axial bore.

3. A tassel according to claim 2, and in which the top element radial slot is of a configuration which is substantially that of a keyhole.

4. A tassel according to claim 2, and in which the slot is operable to accept and retain a venetian blind chain end within the tassel.

5. A tassel according to claim 1, and in which the top element radial slot is of a configuration which is substantially that of a keyhole.

6. A tassel according to claim 5, and in which the base element slot is operable to accept and retain a venetian blind chain end within the tassel.

7. A tassel according to claim 6, and in which the top element includes a radial slot extending outwardly from the top element axial bore.

8. A tassel according to claim 7, and in which the top element radial slot is of a configuration which is substantially that of a keyhole.

9. A tassel according to claim 8, and in which the slot is operable to accept and retain a venetian blind chain end within the tassel.

10. A tassel according to claim 5, and in which the top element includes a radial slot extending outwardly from the top element axial bore.

11. A tassel according to claim 10, and in which the top element radial slot is of a configuration which is substantially that of a keyhole.

12. A tassel according to claim 11, and in which the slot is operable to accept and retain a venetian blind chain end within the tassel.

* * * * *